US011614079B2

(12) United States Patent
Poehls et al.

(10) Patent No.: US 11,614,079 B2
(45) Date of Patent: Mar. 28, 2023

(54) SUCTION BORE COVER AND SEAL ARRANGEMENT

(71) Applicant: SPM Oil & Gas Inc., Fort Worth, TX (US)

(72) Inventors: Justin Lane Poehls, Glen Rose, TX (US); Justin Rand Cummings, Fort Worth, TX (US); Edward Charles Kotapish, Willow Park, TX (US); Adalberto Cortes, Fort Worth, TX (US); Johnny E. Deleon, II, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 6 days.

(21) Appl. No.: 16/977,447

(22) PCT Filed: Mar. 1, 2019

(86) PCT No.: PCT/US2019/020446

§ 371 (c)(1),
(2) Date: Sep. 1, 2020

(87) PCT Pub. No.: WO2019/169366

PCT Pub. Date: Sep. 6, 2019

(65) Prior Publication Data

US 2020/0400130 A1 Dec. 24, 2020

Related U.S. Application Data

(60) Provisional application No. 62/637,987, filed on Mar. 2, 2018.

(51) Int. Cl.
*F04B 1/0448* (2020.01)
*F04B 53/16* (2006.01)
*E21B 43/26* (2006.01)

(52) U.S. Cl.
CPC ..... *F04B 1/0448* (2013.01); *E21B 43/2607* (2020.05); *F04B 53/16* (2013.01)

(58) Field of Classification Search
CPC ..... F04B 1/0448; F04B 53/007; F04B 53/16; E21B 43/2607
See application file for complete search history.

(56) References Cited

U.S. PATENT DOCUMENTS 1,771,012 A * 7/1930 Schwartz ..... B65D 39/084 220/259.4
5,862,936 A * 1/1999 Johanson ..... B65D 39/08 220/304

(Continued)

FOREIGN PATENT DOCUMENTS

WO 2017-096488 A1 6/2017

OTHER PUBLICATIONS

International Search Report and Written Opinion received in Patent Cooperation Treaty Application No. PCT/US2019/020446, dated May 6, 2019.

*Primary Examiner* — Connor J Tremarche

(57) ABSTRACT

A suction cover assembly for a frac pump includes a suction cover having an annular base flange defining a sealing interface proximate to the base flange. The suction cover is dimensioned to be accommodated within a bore well of a fluid cylinder in the pump. An annular seal is seated on the sealing interface proximate to the base flange of the suction cover.

7 Claims, 6 Drawing Sheets

(56) References Cited

U.S. PATENT DOCUMENTS

| | | | | |
|---|---|---|---|---|
| 6,726,048 | B2 * | 4/2004 | Dwinell | B65D 39/08 220/259.3 |
| 7,364,412 | B2 * | 4/2008 | Kugelev | F04B 53/007 417/454 |
| 2005/0034875 | A1 | 2/2005 | McLoughlin et al. | |
| 2010/0301069 | A1 | 12/2010 | Bensley | |
| 2014/0044577 | A1 | 2/2014 | Shreve et al. | |
| 2015/0144826 | A1 | 5/2015 | Bayyouk et al. | |
| 2017/0146011 | A1 * | 5/2017 | Hiller | F04B 53/16 |
| 2018/0291892 | A1 * | 10/2018 | Vicars | F04B 53/16 |

* cited by examiner

SUCTION BORE COVER AND SEAL ARRANGEMENT

RELATED APPLICATION

This application is a national phase application of Patent Cooperation Treaty Application No. PCT/US2019/020446 filed Mar. 1, 2019, which claims priority to U.S. Provisional Application No. 62/637,987 filed Mar. 2, 2018.

FIELD

The present disclosure relates to hydraulic fracturing pumps, and in particular, to a novel suction bore cover and seal arrangement.

BACKGROUND

Hydraulic fracturing (a.k.a. fracking) is a process to obtain hydrocarbons such as natural gas and petroleum by injecting a fracking fluid or slurry at high pressure into a wellbore to create cracks in deep rock formations. The hydraulic fracturing process employs a variety of different types of equipment at the site of the well, including one or more positive displacement pumps, slurry blender, fracturing fluid tanks, high-pressure flow iron (pipe or conduit), wellhead, valves, charge pumps, and trailers upon which some equipment are carried.

Positive displacement pumps are commonly used in oil fields for high pressure hydrocarbon recovery applications, such as injecting the fracking fluid down the wellbore. A positive displacement pump may include one or more plungers driven by a crankshaft to create a high or low pressure in a fluid chamber. A positive displacement pump typically has two sections, a power end and a fluid end. The power end includes a crankshaft powered by an engine that drives the plungers. The fluid end of the pump includes cylinders into which the plungers operate to draw fluid into the fluid chamber and then forcibly push out at a high pressure to a discharge manifold, which is in fluid communication with a well head.

BRIEF DESCRIPTION OF THE DRAWINGS

FIG. 8 is a close-up of the D-ring seal and wash region;

DETAILED DESCRIPTION

The positive displacement pump commonly deployed at a frac site includes seals on its pony rods in the power end, or flow valves, suction valves, discharge valves, etc. in the fluid end. Such seals operate in harsh conditions, including high pressure (up to 15000 psi), continuous-duty (e.g., full rod load at 120 RPM), and in corrosive (e.g., up to 18% HCl) and high abrasive liquids. The valves must remain in service for a long life without leakage and other failure and be cost-effective to replace. Suction covers are used to provide closure and seal valve access ports. They are typically sealed with pressure energized seals, O-rings, or D-ring seals.

Figure 7:
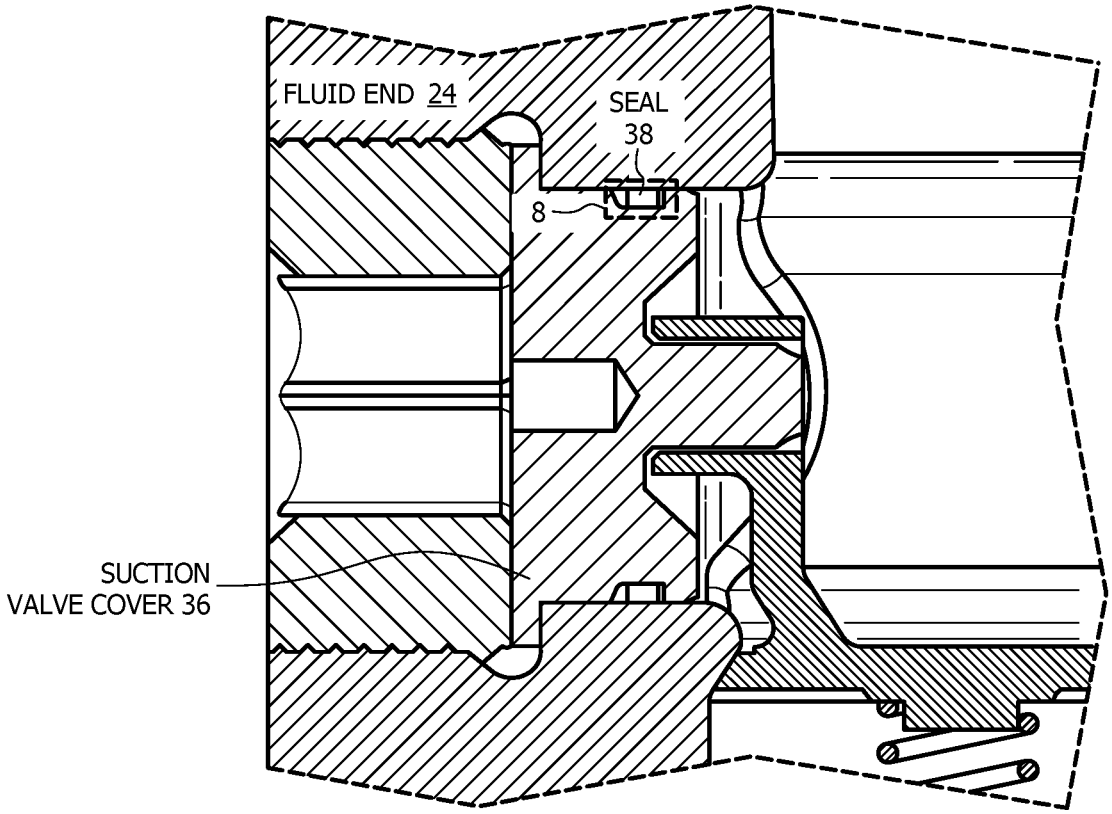
FIGS. 7 and 8 are partial cross-sectional views of a prior suction cover and seal, where
Figure 8:
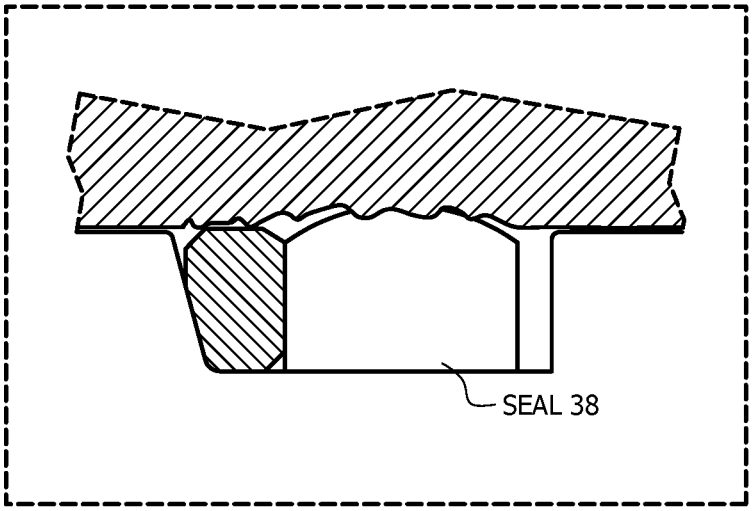

Referring first to FIG. 7, a cross-sectional view of a conventional disc-shaped suction cover with a D-ring seal is shown, with a close-up of the D-ring seal shown in FIG. 8. The D-ring seal prevents pressure leaks from the fluctuating pressure in the cross bores in the fluid cylinder of the pump. One of the most common reasons for failure and pressure loss is caused by wash or surface wear in the suction bore at the seal location. Because of the seal location and the high pressure and harsh abrasive fluid, wash rings are created on the suction bore of the fluid end of the pump, as shown in FIG. 8. Once the bore is washed (i.e., suffers from surface wear), the D-ring seal can no longer hold pressure, even if a new seal is installed as replacement. In most situations, the frac site operator will continue to run and wash the block until complete failure occurs. One theory on the causes of wash in the bore is weakening of the seal during installation. Because of the location of the seal, it has to be stretched over the worn or damaged suction cover in order to install it. This stretching of the seal over this worn surface may potentially cut and damage the structural integrity of the seal and lead to its premature failure.

Figure 1:
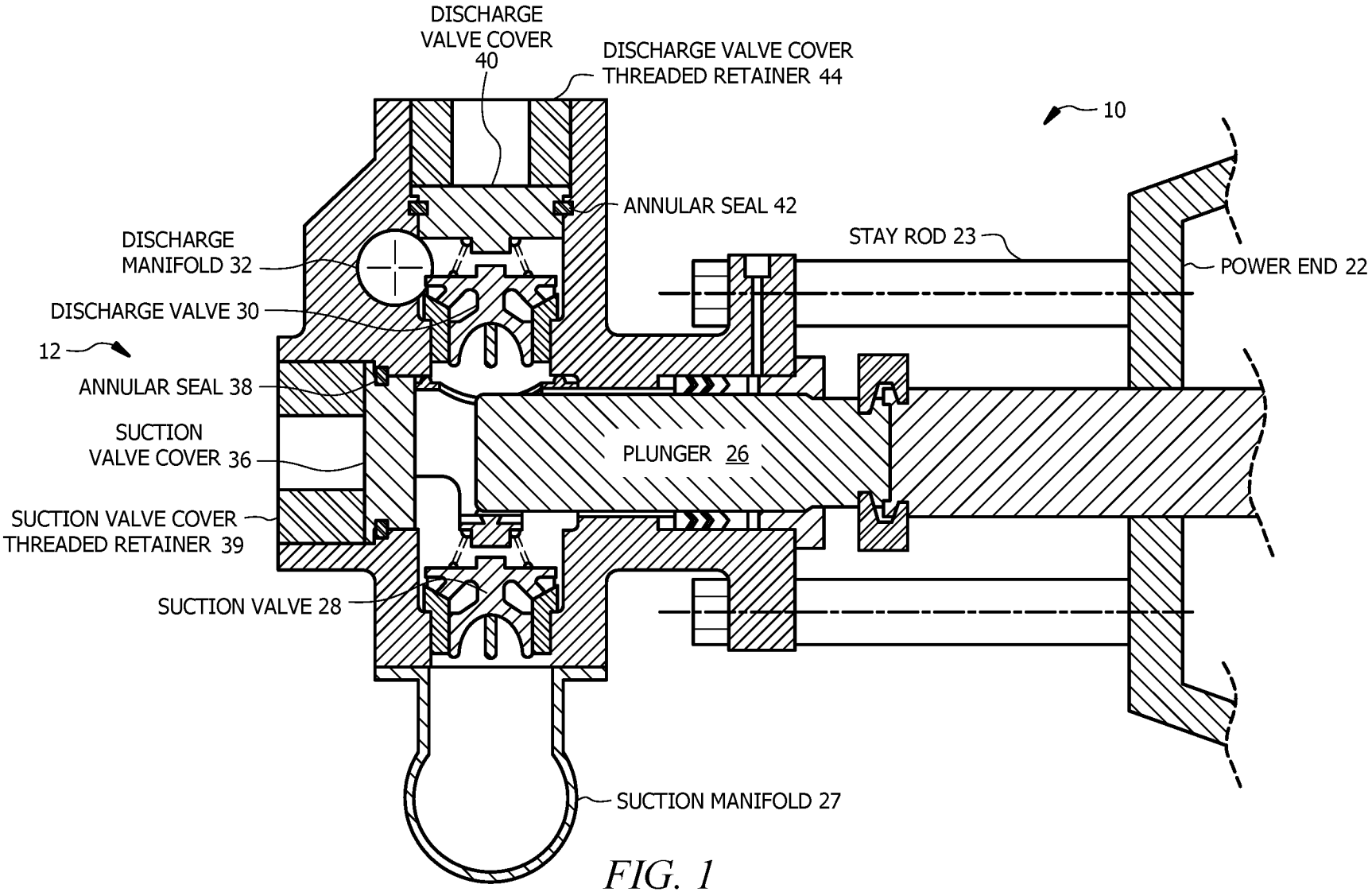
FIG. 1 is a partial cross-sectional view of a fluid end of a positive displacement pump including an exemplary embodiment of a novel suction cover and seal arrangement according to the teachings of the present disclosure.
Figure 2:
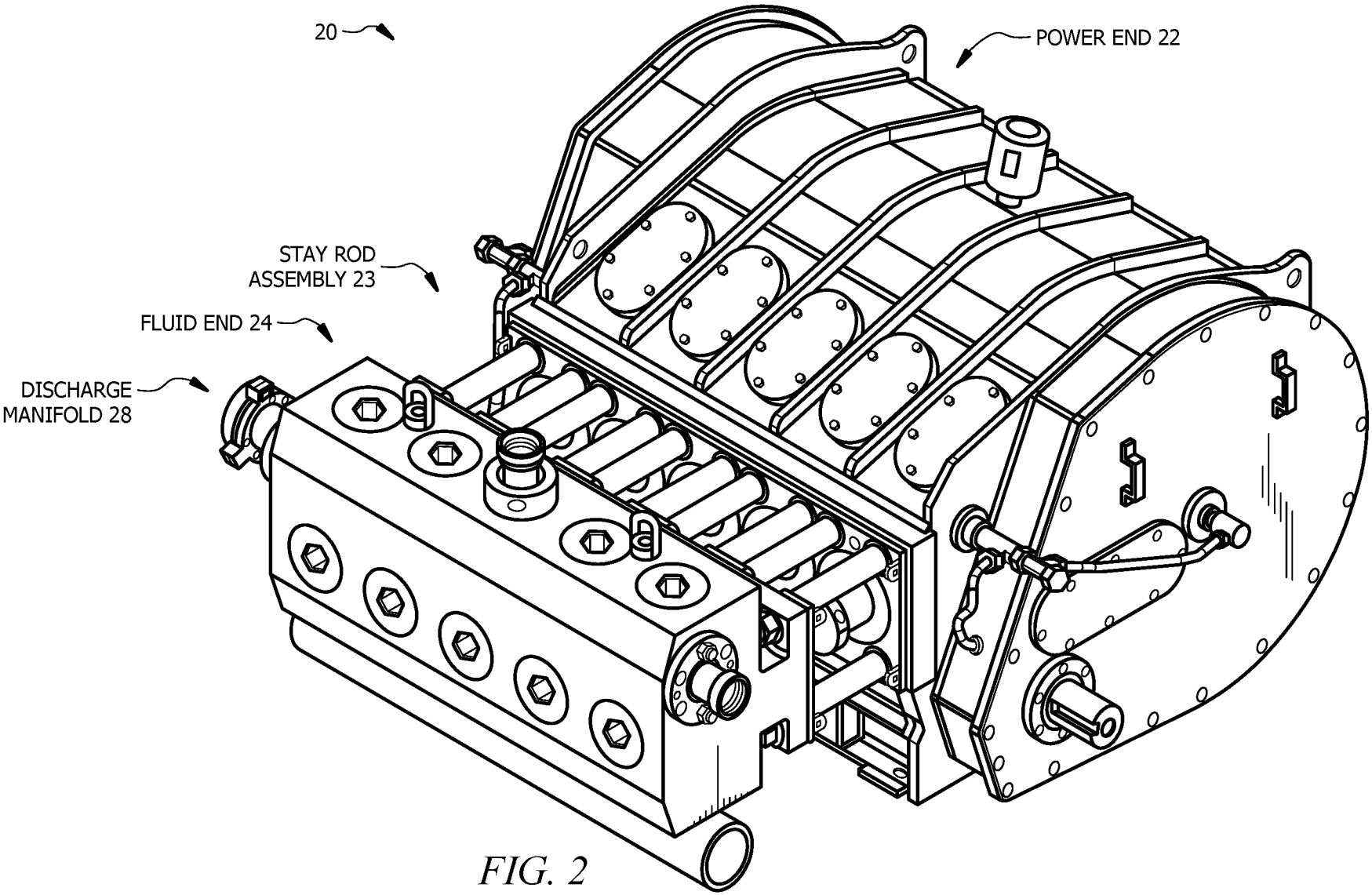
FIG. 2 is a perspective view of a positive displacement pump according to the teachings of the present disclosure.

FIG. 1 is a partial cross-sectional view of a fluid end 24 of a positive displacement pump including an exemplary embodiment of a novel suction cover and seal arrangement 12 according to the teachings of the present disclosure. FIG. 2 is a perspective view of an exemplary embodiment of a positive displacement pump 20. Referring to both figures, the positive displacement pump 20 has two sections, a power end 22 and a fluid end 24 connected by a stay rod tube section 23. The power end 22 includes a crankshaft powered by an engine, transmission, electric motor, hydraulic motor, etc. that rotationally drive a crankshaft. A connecting rod, attached to a pin located eccentrically from the crankshaft centerline, converts rotational motion into linear motion and terminates at a wrist pin and a series of plungers 26. The plunger piston slides coaxially inside a fluid chamber, alternately increasing and decreasing chamber volume. The plungers 26 operate to draw fluid from a suction manifold 27 into the fluid chamber through an intake or suction valve 28, and then discharge the fluid at a high pressure through a discharge valve 30 to a discharge manifold 32. The discharged liquid is then injected at high pressure into an encased wellbore. The injected fracturing fluid is also commonly called a slurry, which is a mixture of water, proppants (silica sand or ceramic), and chemical additives. The novel suction cover and seal concept described herein can be employed for a suction valve, a discharge valve, and any valve and seal present in the frac pump, as well as other types of equipment that may be present at an exemplary hydraulic fracturing site and elsewhere in other applications. An exemplary hydraulic fracturing site employs positive displacement pumps, a slurry blender, fracturing fluid tanks, high-pressure flow iron (pipe or conduit), trailers upon which some equipment are carried, valves, wellhead, charge pump (typically a centrifugal pump), conveyers, and other equipment at the site of a hydraulic fracturing operation or other types of hydrocarbon recovery operations.

As shown in FIG. 1, the disc-shaped suction cover 36 is situated in the cross bore of the pump fluid cylinder. The suction cover 36 includes an annular seal 38 and is held in place by a suction cover threaded retainer 39. Similarly, the discharge valve assembly may include a discharge suction cover 40 and an annular seal 42 held in place by a discharge suction cover threaded retainer 42. The annular seal(s) may have a cross-section that is circular, elliptical, D-shaped, square, rectangular, or any other suitable shape.

Figure 3:
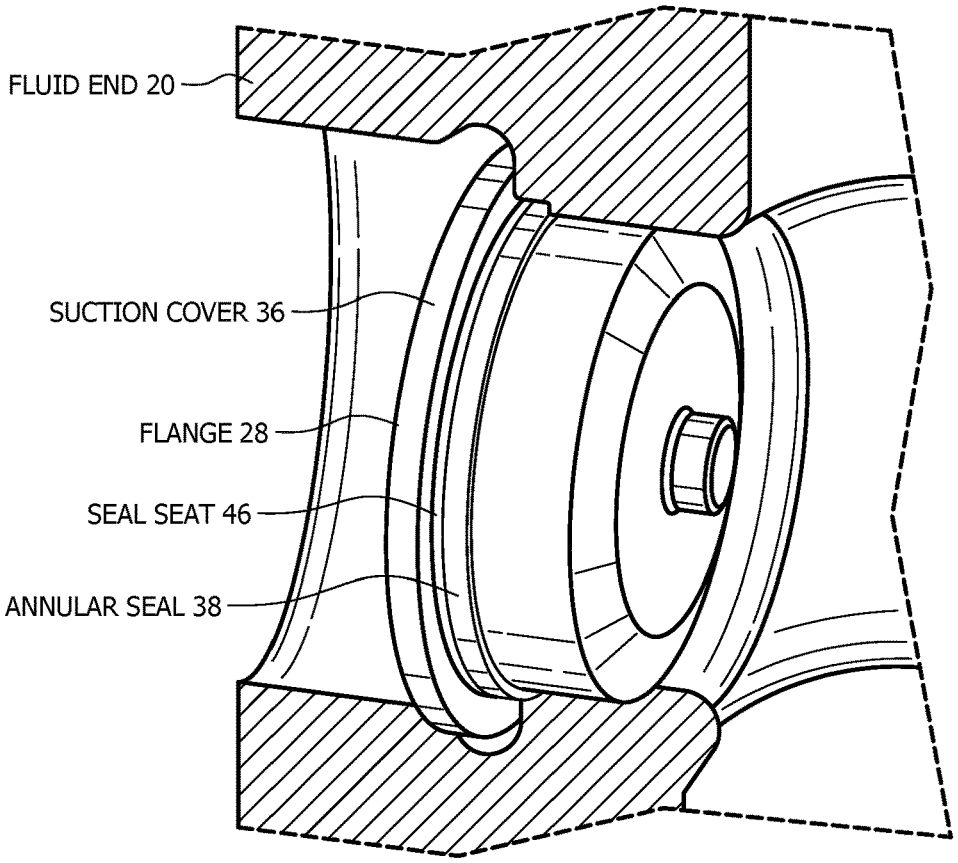
FIG. 3 is a more detailed view of an exemplary embodiment of a novel suction cover and seal arrangement according to the teachings of the present disclosure.
Figure 4:
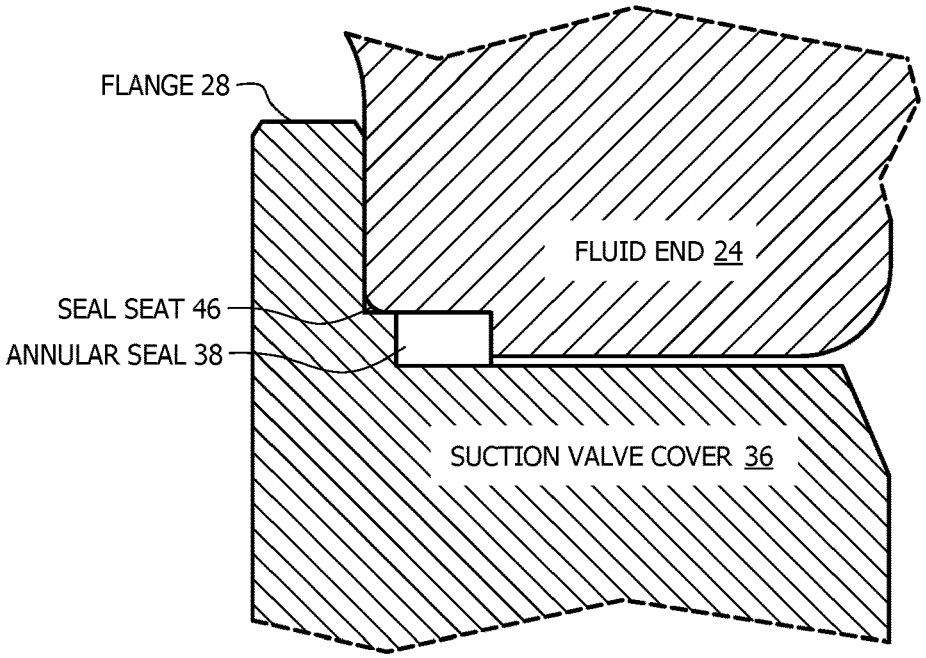
FIG. 4 is a more detailed cross-sectional view of an exemplary embodiment of a novel suction cover and seal arrangement according to the teachings of the present disclosure.

As shown in FIG. 1, and in more detail in FIGS. 3 and 4, an exemplary embodiment of the suction cover and seal arrangement 12 includes a suction cover 36 with an annular seal 38. The suction cover 36 has a base flange 28 forming a sealing interface, and a stepped seal seat 46 upon which the annular seal 38 is situated. The suction cover 36 is dimensioned to be accommodated within a bore well of a fluid cylinder in the pump.

Figure 5:
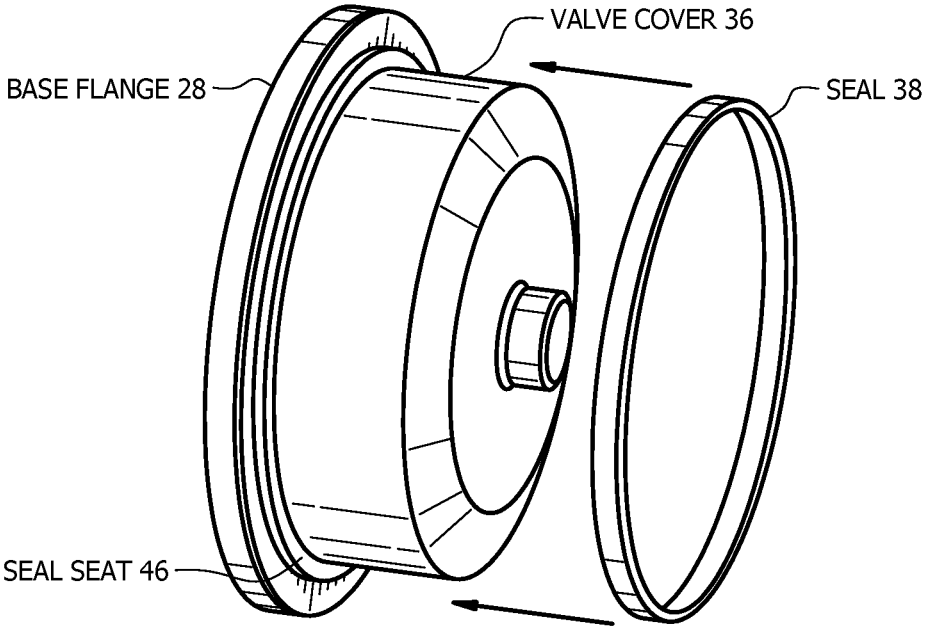
FIGS. 5 and 6 are perspective views of an exemplary embodiment of a novel suction cover and seal arrangement according to the teachings of the present disclosure.
Figure 6:
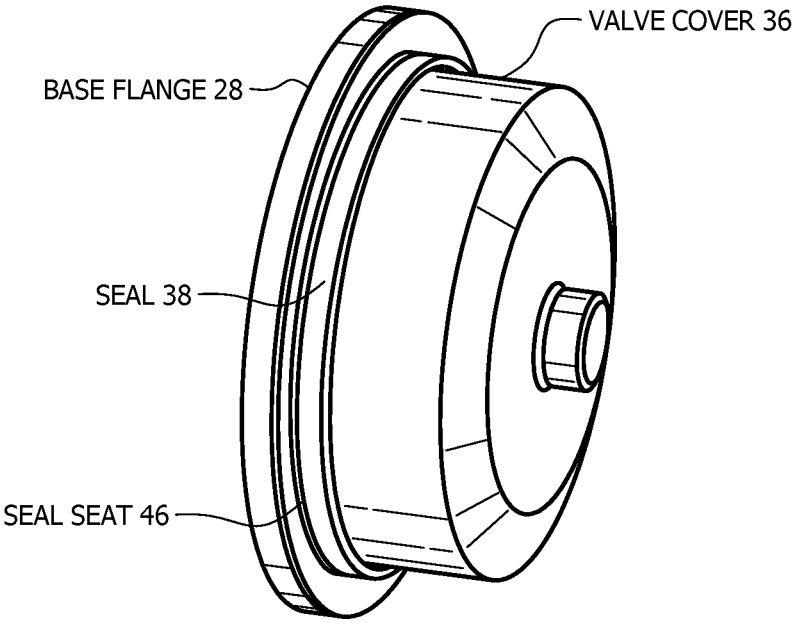

As further shown in FIGS. 5 and 6, the circular seal 38 can be installed by sliding it over the suction cover 36 onto the seal seat 46 proximate to the base flange 28. This can be performed without stretching the seal that may adversely impact the structural integrity of the seal.

Figure 9:
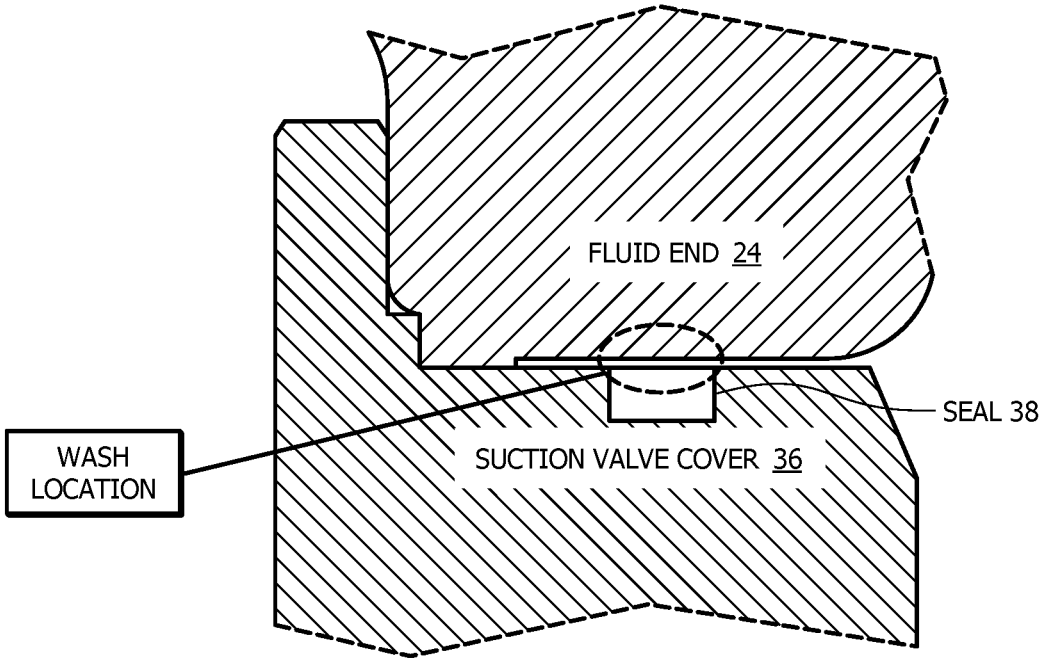
FIG. 9 is a partial cross-sectional view of the prior suction cover and seal showing its wash location.
Figure 10:
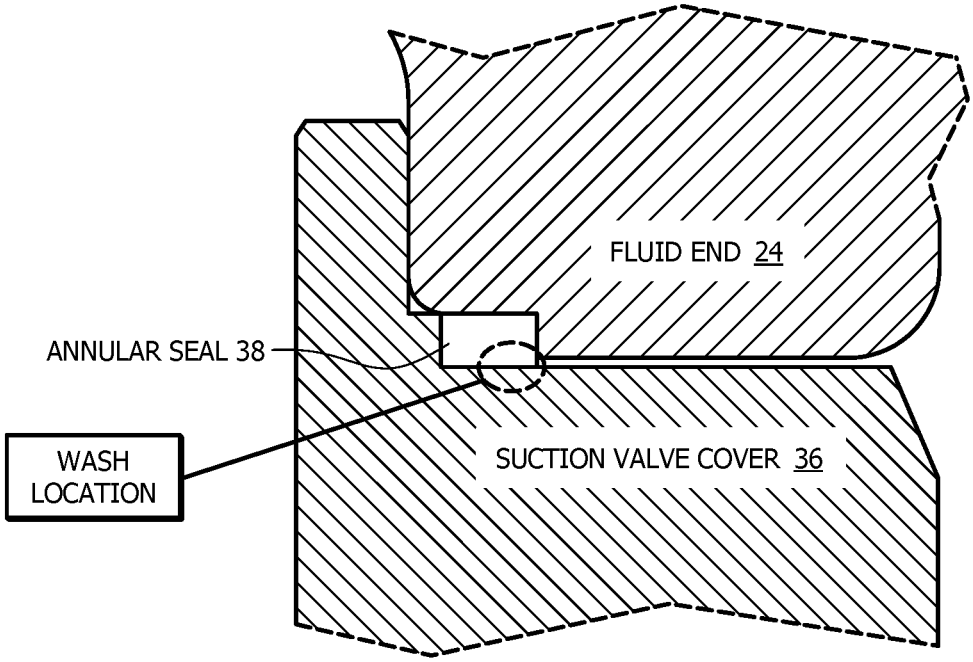
FIG. 10 is a partial cross-sectional view of an exemplary embodiment of a novel suction cover and seal arrangement showing its wash location according to the teachings of the present disclosure.

FIGS. 9 and 10 provide a side-by-side comparison of the conventional and new designs. FIG. 9 is a partial cross-sectional view of the conventional suction cover with the D-ring seal showing the location of the wash, which is at the interface between the seal and the fluid end bore wall. FIG. 10 is a partial cross-sectional view of a new suction cover design showing the location of the wash, which is now located at the interface between the seal 38 and the suction cover 36. By changing the location of the seal, wash in the bore is mitigated and the suction cover now experiences surface wear, if any, which is a much more cost-effective part to replace and service than the fluid end bore. Further, the seal gland is split into two pieces, which allows the seal gland to be opened up and the seal slid into place onto the base flange and seal seat of the suction cover, as shown in FIGS. 5 and 6. Because the new installation process does not require stretching the seal allows the seal design to be more rigid and durable.

The novel suction cover and seal configuration described herein involves (a) changing the seal location, (b) changing the sealing surface to act on the suction cover rather than the fluid end bore, and (c) engineered seals that are more durable because the seal can be slid onto the cover into place.

The features of the present invention which are believed to be novel are set forth below with particularity in the appended claims. However, modifications, variations, and changes to the exemplary embodiments described above will be apparent to those skilled in the art, and the novel suction cover and seal design described herein thus encompasses such modifications, variations, and changes and are not limited to the specific embodiments described herein.

What is claimed is:

1. A frac pump comprising:

a power end;

a fluid end having a suction bore, the suction bore including a step, wherein a first inner diameter of the step is greater than a second inner diameter of the suction bore;

a suction cover configured for sealing the suction bore, the suction cover having:

an annular base flange with a first outer diameter greater than the first inner diameter of the step;

a seal seat extending from the annular base flange in a first longitudinal direction, the seal seat having a second outer diameter less than the first outer diameter of the annular base flange and the seal seat defining a sealing interface, wherein the second outer diameter of the seal seat is equal to or less than the first inner diameter of the step and greater than the second inner diameter of the suction bore whereby the seal seat is configured to fit within the first inner diameter of the step without fitting within the second inner diameter of the suction bore; and a distal portion extending from the seal seat in the first longitudinal direction, the distal portion having a third outer diameter less than the second outer diameter of the seal seat; and an annular seal seated on the seal seat and having a third inner diameter equal to or greater than the third outer diameter of the distal portion of the suction cover, wherein the annular seal contacts at least a portion of the step of the suction bore when the suction cover is fit within the suction bore.

2. The frac pump of claim 1, wherein the annular seal and the suction cover define a wash interface away from the suction bore.

3. The frac pump of claim 1, wherein the annular seal and the suction cover form a wash interface between the annular seal and the suction cover proximate to the seal seat.

4. The frac pump of claim 1, wherein the seal seat is concentric with the annular base flange.

5. The frac pump of claim 1, wherein a wash interface is defined on a surface corresponding to the third outer diameter of the suction cover.

6. The frac pump of claim 1, wherein the annular seal is configured to fit around the distal portion of the suction cover, based on the third inner diameter being equal to or greater than the third outer diameter, without stretching the annular seal.

7. The frac pump of claim 1, wherein a fourth outer diameter of the annular seal is substantially equal to each of the second outer diameter of the seal seat and the first inner diameter of the step of the suction bore.

* * * * *